US005901658A

United States Patent [19]

Kirkland

[11] Patent Number: 5,901,658

[45] Date of Patent: May 11, 1999

[54] PEDESTAL SEAT LOCKING STRUCTURE

[75] Inventor: Perry Glen Kirkland, Desoto, Tex.

[73] Assignee: Brunswick Corporation, Lake Forest, Ill.

[21] Appl. No.: 08/887,158

[22] Filed: Jul. 2, 1997

[51] Int. Cl.[6] ..... B63B 17/00

[52] U.S. Cl. ..... 114/363

[58] Field of Search ..... 114/363; 297/313; 248/158

[56] References Cited

U.S. PATENT DOCUMENTS 2,787,315 4/1957 Siebert ..... 114/363

4,587,921 5/1986 Curry ..... 114/363

4,865,283 9/1989 Parker ..... 248/159

*Primary Examiner*—Stephen Avila

*Attorney, Agent, or Firm*—Rosenblatt & Redano, P.C.

[57] ABSTRACT

A pedestal structure for a boat seat is disclosed which is a push-together design. The pedestal is made of at least two components, one of which has a male end insertable into a bushing. The bushing has an opening adjacent its lower end to receive the male end in an interference fit. The bushing has sufficient flexibility to allow the male end to pass whereupon a recess shoulder on the male end is trapped by the bushing. The pedestal can still swivel but a pull-apart force of a predetermined value is required in order to assemble or pull apart the seat pedestal assembly.

18 Claims, 3 Drawing Sheets

PEDESTAL SEAT LOCKING STRUCTURE

FIELD OF THE INVENTION

The field of this invention relates to pedestal-type swivel seats for boats.

BACKGROUND OF THE INVENTION

Swivel seats have been known in both office and boating environments. Known swivel designs are illustrated in U.S. Pat. Nos. 2,872,223; 2,021,187; 3,327,656; 4,828,212; and 4,928,620.

Fishing boats have had swivel seats for many years. Fishing boats have also been manufactured to voluntary standards of the American Boat and Yacht Council based in Edgewater, Md. One of the requirements of standards promulgated by the American Boat and Yacht Council for Type B seating on boats is to have such seating meet various parameters. One of the standards is resistance to vertical loads. The seat pedestal assembly is to remain as a unit when subjected to a vertical pull-apart force of a predetermined value.

Certain seats in boats, such as those primarily used when trolling, need to be easily assembled and disassembled. In order to meet the standards of the American Boat and Yacht Council or other regulatory agencies or standard-setting organizations, a pedestal assembly has been developed for a swivel seat in a boat which is easy to put together without any tools and which does not require the boat occupants to handle small parts which could easily be lost in the boat or overboard. Instead, a pedestal assembly has been developed which is easy to assemble by pushing it together in such a manner so that it can resist a push-apart force within the governing specifications, while at the same time allowing the boat occupants to readily disassemble the pedestal assembly for storage in the boat when underway. In order to avoid accidents, governing regulations in the United States by organizations such as the American Boat and Yacht Council indicate that it is advisable to place a warning label on such types of seats indicating that they should not be occupied when boat speed exceeds 5 miles per hour and that the seat should be removed when it is not being occupied. Accordingly, a design was required that met such voluntary standards or other applicable standards for resistance to disassembly while at the same time was easy to assemble and simple in its construction. This was accomplished in a push-together design of the present invention which retains the swivel feature while at the same time possessing the pull-out resistance feature to comply with voluntary or mandatory standards.

SUMMARY OF THE INVENTION

A pedestal structure for a boat seat is disclosed which is a push-together design. The pedestal is made of at least two components, one of which has a male end insertable into a bushing. The bushing has an opening adjacent its lower end to receive the male end in an interference ft. The bushing has sufficient flexibility to allow the male end to pass whereupon a recess shoulder on the male end is trapped by the bushing. The pedestal can still swivel but a push-apart force of a predetermined value is required in order to assemble or pull apart the seat pedestal assembly.

DETAILED DESCRIPTION OF THE PREFERRED EMBODIMENT

Figure 1:
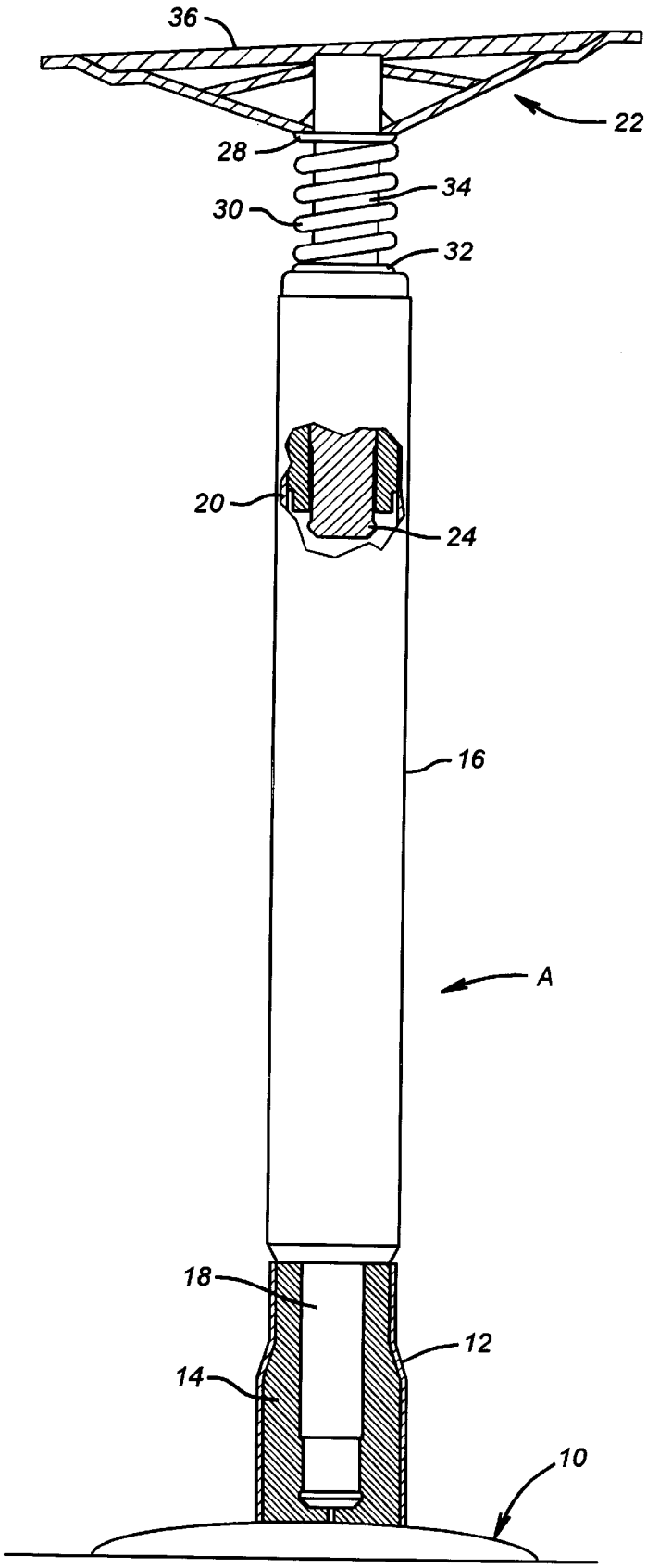
FIG. 1 is an assembled view of a seat pedestal assembly showing a three-component system in the assembled state.
Figure 2:
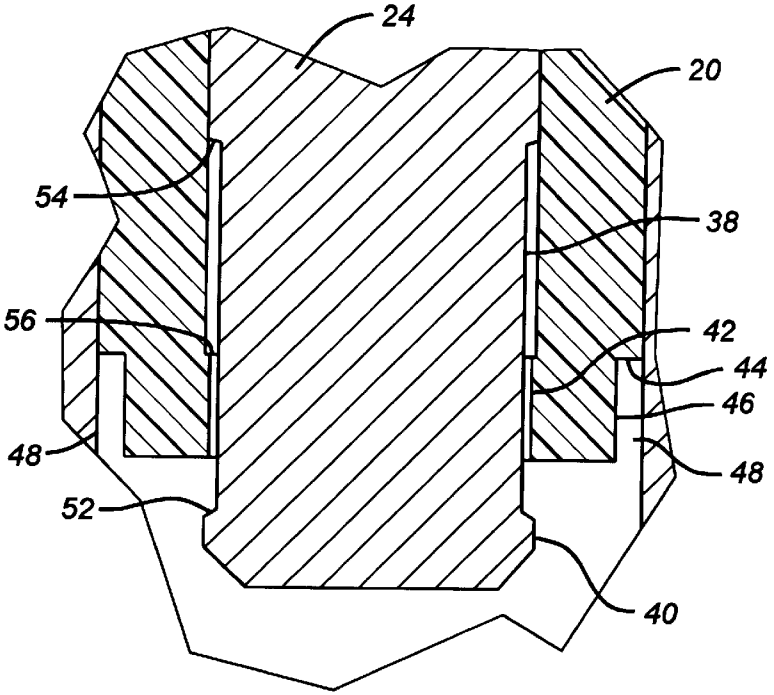
FIG. 2 is a detail of the male end snapped into the bushing when the components are assembled.

Referring to FIG. 1, the pedestal apparatus A of the present invention is shown in three components. A base 10 is secured to a suitable portion of the boat (not shown). Base 10 has an elongated housing 12, within which is mounted a bushing 14. A connection tube 16 has a male end 16 which is insertable into bushing 4 at one end. At its opposite end, the tube 16 has a bushing 20, which is preferably identical to bushing 14. The seat support 22 has a male end 24 which is insertable into bushing 20 as shown in FIG. 2.

The seat support 22 comprises a bracket 26 bolted to the under side of the seat (not shown). Under the bracket 26 is a washer 28 which rests on spring 30, which is in turn supported by a washer 32 which is attached to the pedestal 34. In this design, the top 36 of the bracket 26 can move with respect to the pedestal 34. As shown in FIG. 2, the male end 24 of the pedestal 34 has a recess 38 and an adjacent surface 40 whose diameter exceeds the diameter of the male end 24 at recess 38. The bushing 20 has an internal diameter 42 which is smaller than the diameter of surface 40. Bushing 20 also has an exterior shoulder 44 with an adjacent surface 46. There is a clearance 48 between surface 46 and the interior wall 48 of connection tube 16. Those skilled in the art will appreciate that the same connection details having just been described can also be employed in attaching the male end 18 into the bushing 14 of base 10.

Figure 4:
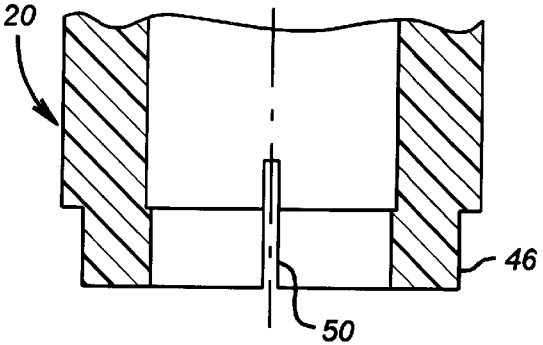
FIG. 4 is an expanded view of the bushing shown in FIGS. 2 and 3.

FIG. 4 illustrates in greater detail the construction of bushing 20 in the preferred embodiment. In FIG. 4, it is easy to see that there is also a longitudinal slot 50 which facilitates the passage of surface 40 beyond diameter 42. One or more such slots 50 can be used or alternative means which allows the diameter 42 to grow as the surface 40 is pushed past it and to resume its original dimension as recess 38 is juxtaposed against the surface forming diameter 42.

Figure 3:
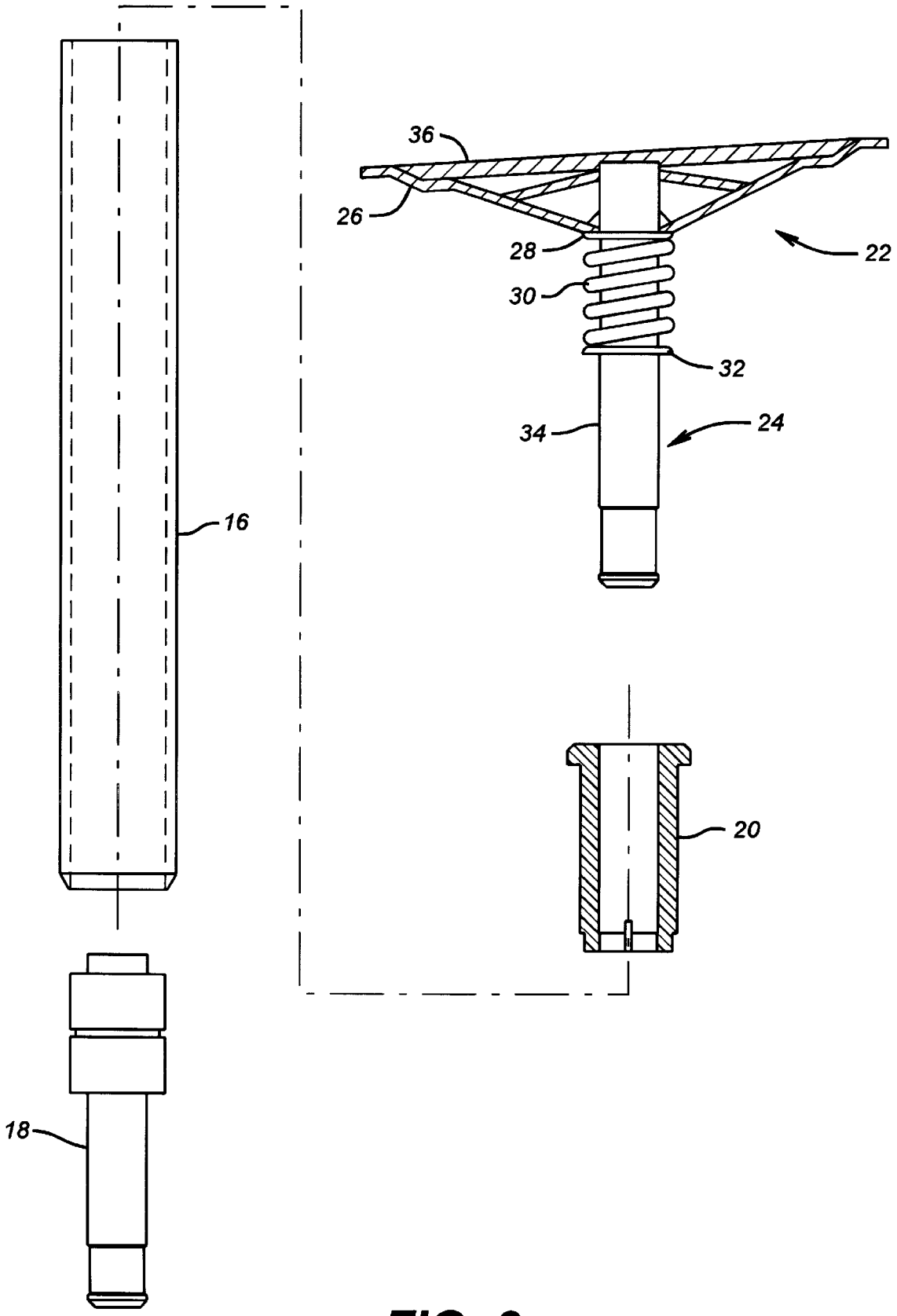
FIG. 3 is an exploded view showing the upper two pieces of a three-piece assembly for the seat pedestal of the present invention.

What is presented is a pedestal assembly that can be pushed together with a tube 16 having a male end 18 insertable into bushing 14 of bass 10. To complete the assembly, the seat support 22 having a male end 24 can be inserted into the bushing 20. At that point, the top 36 which is attached to the seat (not shown) is rotatable as pedestal 34 rotates with respect to the bushing 20. Alternatively, the upper two-thirds of the assembly can rotate for a swivel action of the seat in tandem with each other as the male end 18 rotates with respect to the bushing 14. The entire assembly can be made up in two or more components where one is the bass such as 10, and components 22 and 16 comprise a unitary structure with a male end 18. However, for ease of stowage of the assembly, it is preferred to use the three-piece construction that is disclosed in FIG. 1. The spring 30 is an optional feature to give some cushion to the seat mounted to top 36 against bumps encountered by the boat while underway. However, the bracket 26 can be rigidly affixed to the seat support 2 without departing from the spirit of the invention. As shown in FIG. 3, the male end 18 can also be removably mounted with respect to the tube 16.

Using the design as shown, the components can be readily snapped together and still provide a swivel action to the seat. The snap-together components retain their assembled condition against a vertical load of a predetermined value which can be varied by design, using different values for the diameter of surface 40 coupled with the diameter of surface 42, and/or varying the size and quantity of slots 50 or the material of construction of the bushing 20. In the preferred embodiment, the bushings 20 and 14 can be made from PTFE, also known by the trademark Teflon, or other suitable plastic or flexible materials which will allow the bushing such as 20 or 14 to flex to accommodate the passage of surface 40.

It should be noted that the presence of the clearance 48 allows the lower end of the bushing 20 to flex radially outwardly, as accommodated by the longitudinal slots 50, so that the surface 40 can get by the expanding diameter 42 of the bushing 20 until such time as the bushing 20 snaps back into recess 38. Thereafter, as shown in FIG. 2, the recess 38 is trapped within bushing 20 between the shoulders 52 and 54 found on either end thereof. Shoulder 54 rests on shoulder 56 of bushing 20 to support the male end 24 of a pedestal such as 34. The bushing 20 snaps over surface 40 to trap the recess 38. Relative rotation is possible after the snap fit and no small parts are required to put the assembly together.

Figure 5:
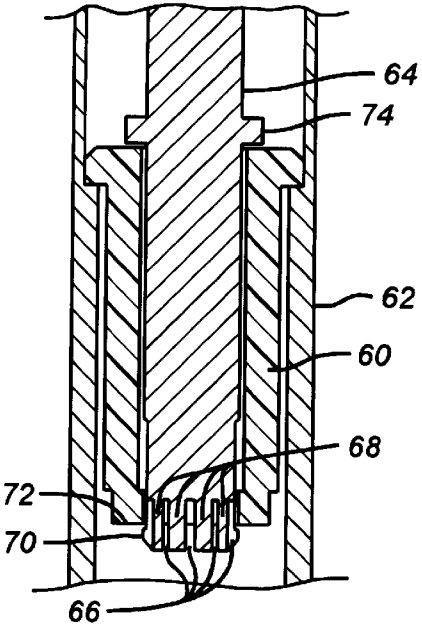
FIG. 5 is an alternative embodiment showing a flexible male end entering a bushing.

Referring now to FIG. 5, an alternative embodiment is illustrated wherein a bushing 60 is inserted into a tube 62. The male end of the pedestal 64 has a series of longitudinal slots 66 defining flexible fingers 68, each of which has a projection 70 which engages the lower end 72 of the bushing 60. Thus, when the lower end of the pedestal 64 is pressed into the bushing 60, the lower end at fingers 68 flexes to allow the tab 70 to enter the bushing 60 and then sprang outwardly below the lower and 72 for a releasable engagement. Thus, the embodiment of FIG. 5 illustrates an alternative to a flexible bushing. In the embodiment of FIG. 5, the bushing 60 is more rigid, while the lower and of the pedestal 64 is flexible to allow interengagement with the bushing 60. While one proposed embodiment of a flexible lower end on the pedestal 64 is illustrated in FIG. 5, other techniques of interengagement in lieu of tab 70 can be employed to releasably fixate the lower end of the pedestal 64 to the bushing 60, all without departing from the spirit of the invention. The pedestal 64 may also have a travel stop 74 to engage the bushing 60 at the top at about the same time that the tabs 70 have cleared the lower end 72 of the bushing 60 so as to secure its position vertically while allowing it to swivel.

The foregoing disclosure and description of the invention are illustrative and explanatory thereof, and various changes in the size, shape, and materials, as well as in the details of the illustrated construction, may be made without departing from the spirit of the invention.

I claim:

1. A swivel seating assembly for a boat seat, comprising:

a base;

a pedestal having a first end securabie to a seat and a second end engageable to said base;

said base retaining said second end of said pedestal against a pull-out force of a predetermined value while at the same time permitting said pedestal to swivel with respect to said base in opposed direction without release.

2. A swivel seating assembly for a boat seat, comprising:

a base;

a pedestal having a first end securable to a seat and a second end engageable to said base;

said base retaining said second end of said pedestal against a pull-out force of a predetermined value while at the same time permitting said pedestal to swivel with respect to said base; and said pedestal is retained to said base by a snap fit of a male end on one of said base and pedestal engaging a bushing having a longitudinal axis on the other of said base and pedestal.

3. The assembly of claim 2, wherein:

said bushing having a flexible component;

said male end is insertable into said bushing such that said bushing is radially displaced by said male end and subsequently snaps back to retain said male end to said bushing.

4. The assembly of claim 3, wherein:

said male end formed having a recess and a first diameter;

said bushing formed having a flexible lower end having a second diameter smaller than said first diameter on said male end;

whereupon advancement of said male end into said bushing spreads said second diameter of said bushing until said first diameter clears said second diameter, at which time said lower end of said bushing snaps into said recess to retain said male end.

5. The assembly of claim 4, wherein:

said lower end of said bushing comprises at least one opening to facilitate flexing of said lower end as said first diameter is advanced.

6. The assembly of claim 5, wherein:

said bushing is mounted to said base with a radial clearance between said lower end and said base to facilitate flexing of said lower end as said first diameter on said pedestal advances.

7. The assembly of claim 2, wherein:

said pedestal is in more than one piece, with each of the pieces engaged to each other or to the base using a snap fit into a bushing.

8. The assembly of claim 5, wherein:

said opening comprises at least one slot extending from the lower end of said bushing.

9. The assembly of claim 8, wherein:

said slot is substantially aligned with said longitudinal axis of said bushing.

10. The assembly of claim 7, wherein:

said pedestal comprises a bracket which is attachable to the seat and is flexibly supported off of said pedestal.

11. The assembly of claim 6, wherein:

said pedestal is in more than one piece, with each of the pieces engaged to each other or to the base using a snap fit into a bushing.

12. The assembly of claim 11, wherein:

said opening comprises at least one slot extending from the lower end of said bushing.

13. The assembly of claim 12, wherein:

said slot is substantially aligned with said longitudinal axis of said bushing.

14. The assembly of claim 13, wherein:

said pedestal comprises a bracket which is attachable to the seat and is flexibly supported off of said pedestal.

15. The assembly of claim 13, wherein:

said bushing is made of PTFE.

16. The assembly of claim 2, wherein:

said male end having a flexible component adjacent its lower end;

said male end is insertable into said bushing such that it is radially displaced by said bushing and subsequently snaps back to retain said male end to said bushing.

17. The assembly of claim 16, wherein:

said male end has a plurality of flexible fingers having at least one tab thereon;

said tab passing through said bushing and engaging the lower end thereof to secure said male end to said bushing.

18. The assembly of claim 17, wherein:

said male end further comprises a travel stop to stop advancement of said male end into said bushing as said tab engages the lower end of said bushing.

* * * * *